United States Patent [19]

Wegwerth

[11] Patent Number: 4,622,080

[45] Date of Patent: Nov. 11, 1986

[54] GUN BARREL, MANDREL AND RELATED PROCESSES

[75] Inventor: Wolfgang Wegwerth, Oberndorf-Neckar, Fed. Rep. of Germany

[73] Assignee: American Metal-Tech, Ltd., Alexandria, VA

[21] Appl. No.: 843,865

[22] Filed: Mar. 24, 1986

Related U.S. Application Data

[63] Continuation of Ser. No. 527,668, Aug. 30, 1983, abandoned.

[30] Foreign Application Priority Data

Jan. 5, 1983 [DE] Fed. Rep. of Germany ..... 3300175

[51] Int. Cl.[4] ..... C21D 9/12

[52] U.S. Cl. ..... 148/12 R; 148/12.4

[58] Field of Search ..... 148/12 R, 12.1, 12.4, 148/16.6, 36, 39, 31.5, 143, 144; 29/1.1

[56] References Cited

U.S. PATENT DOCUMENTS

| | | | |
|---|---|---|---|
| 2,799,959 | 7/1957 | Osborn | 148/16.6 |
| 2,916,409 | 12/1959 | Bucek | 148/16.6 |
| 3,017,793 | 1/1962 | Appel | 29/1.1 |
| 3,382,556 | 5/1968 | Maillard | 29/1.1 |
| 3,538,568 | 11/1970 | Hilton | 29/1.1 |
| 3,753,365 | 8/1973 | Kralowetz | 29/1.1 |
| 3,780,465 | 12/1973 | Polcha | 29/1.1 |

FOREIGN PATENT DOCUMENTS

| | | | |
|---|---|---|---|
| 1927822 | 3/1972 | Fed. Rep. of Germany | 148/12 R |

OTHER PUBLICATIONS

Merriman, A. D.; *A Dictionary of Metallurgy;* MacDonald & Evans, Ltd.; London 1958.

*Primary Examiner*—Wayland Stallard

*Attorney, Agent, or Firm*—Quaintance, Murphy & Presta

[57] ABSTRACT

A gun barrel which is either smooth or has lands and grooves wherein the grooves are both wider and deeper at the chamber than at the muzzle. A mandrel for producing the gun barrel. Processes for producing the gun barrel including steps of heating, quenching, and tempering with optional use of chromizing, vacuum, and noble gases.

24 Claims, 21 Drawing Figures

GUN BARREL, MANDREL AND RELATED PROCESSES

Figure 1:
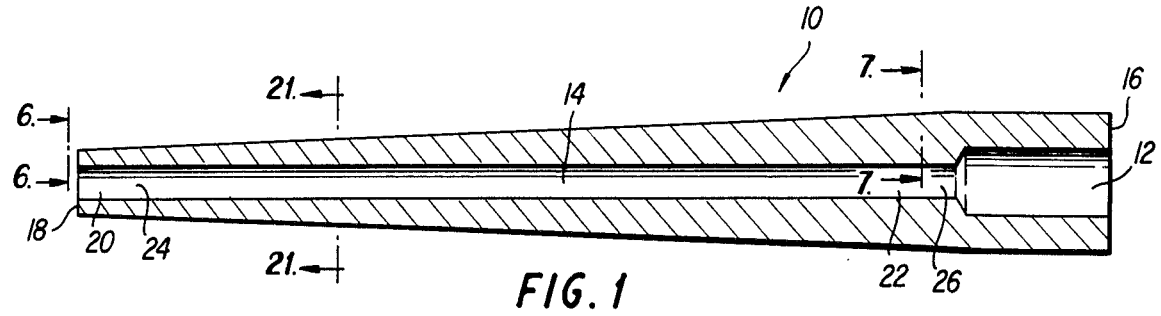

This is a continuation of application Ser. No. 527,668, filed Aug. 30, 1983, abandoned.

Gun barrels having an inside diameter of 20 mm or greater are well known. These gun barrels are commonly made by boring a cylindrical hole through a blank. However, such a process is difficult to control. This prior art process produces a large amount of scrap. Since the metals employed for such gun barrels frequently cost as much as twenty U.S. dollars per kilogram, the amount of scrap increases the cost of each resultant gun barrel. After the cylindrical hole is bored, it must be honed. When the gun barrel is to be rifled, rifling must be added. This multi-step process requires inspection and quality control at the end of each step.

After the gun barrel is produced in accordance with prior art techniques, it must be broken in by firing up to about 200 rounds of ammunition. This breaking in process is time consuming and expensive.

In operation prior gun barrels are subjected to internal wear. This internal wear permits undesirable leakage of gas pass the projectile and results in an undesirable reduction in the speed of the projectile.

Accordingly, it is an object of the present invention to provide an improved process for producing gun barrels which is substantially free of one or more of the disadvantages of prior processes.

Another object is to provide an improved process for producing both rifled gun barrels and gun barrels having smooth bores.

Still another object of the present invention is to provide an improved process which results in a reduced amount of scrap, decreased labor expense and decreased material expense.

Still another object of the present invention is to provide an improved process for producing gun barrels without boring and/or without honing.

Still another object of the present invention is to provide an improved process for producing gun barrels which has a reduced number of steps and which facilitates quality control.

Still another object of the present invention is to provide an improved process for producing gun barrels which require the firing of fewer rounds in order to be fully broken in.

Yet another object of the present invention is to provide an improved process for producing gun barrels which gun barrels exhibit reduced wear and reduced gas leakage and improved life.

Yet another object of the present invention is to provide an improved gun barrel.

Still another object of the present invention is to provide a novel mandrel useful in the process of the present invention to produce gun barrels of the present invention.

Still a further object of the invention is to provide novel processes for producing gun barrels and the like, such processes resulting in substantial savings in materials, energy requirements and time of labor, particularly as compared with heretofore-known processes for producing gun barrels.

Additional objects and advantages of the present invention will be apparent to those skilled in the art by reference to the following detailed description and drawings wherein:

Rifled barrels are known but are difficult to produce generally. One process for producing these gun barrels is to insert a mandrel into the tube and then collapse the tube around the mandrel. It has, however, heretofore been impossible to employ this process to produce gun barrels having an inside diameter greater than 20 mm.

FIG. 1 is a sectional view of a rifle barrel of the present invention; and

Figure 2:
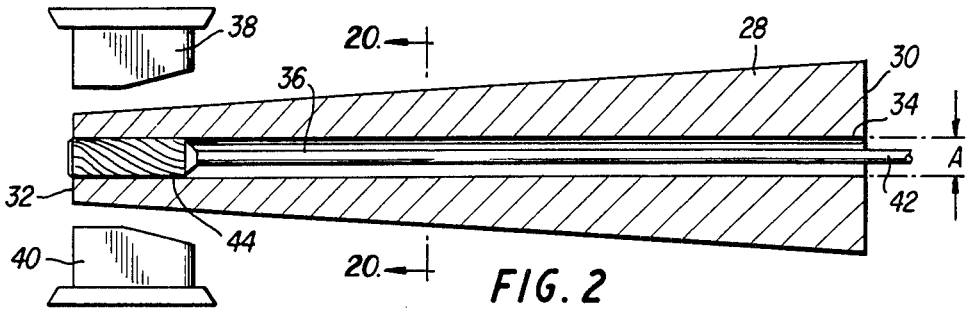
Figure 3:
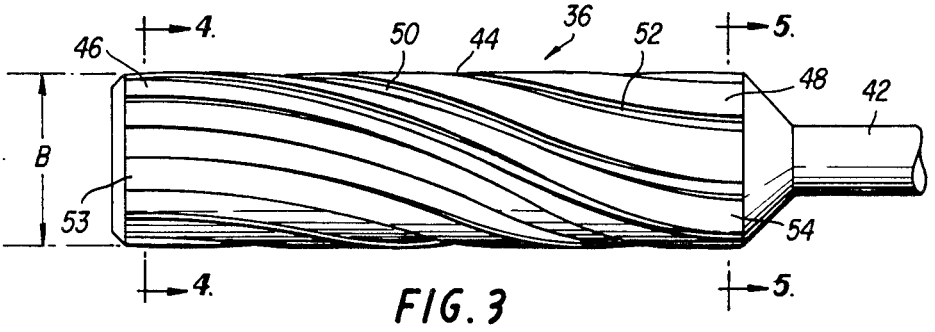
Figure 4:
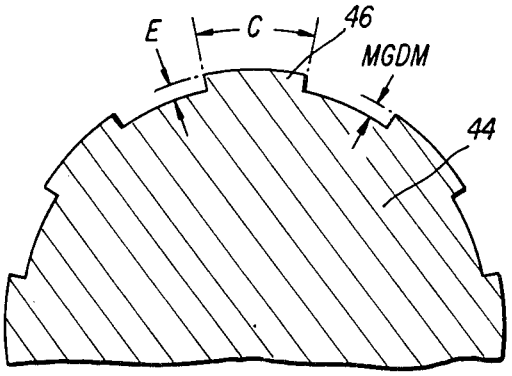
Figure 5:
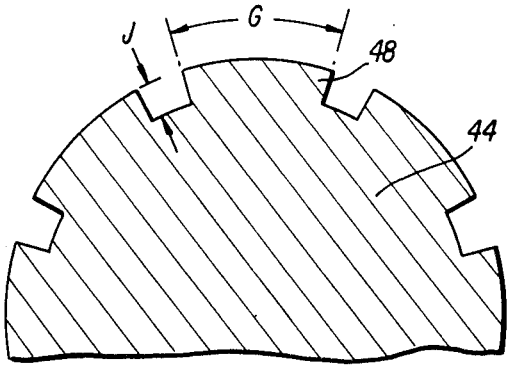
Figure 6:
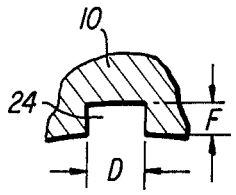
Figure 7:
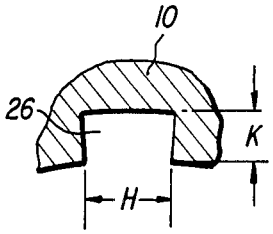
Figure 8:
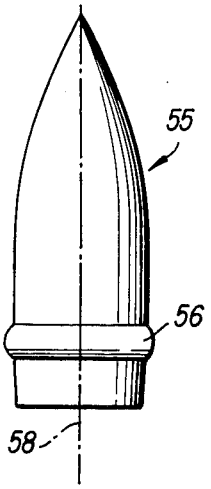
Figure 20:
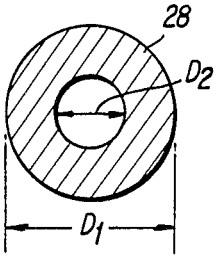
Figure 21:
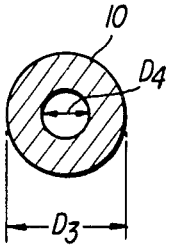
Figure 9:
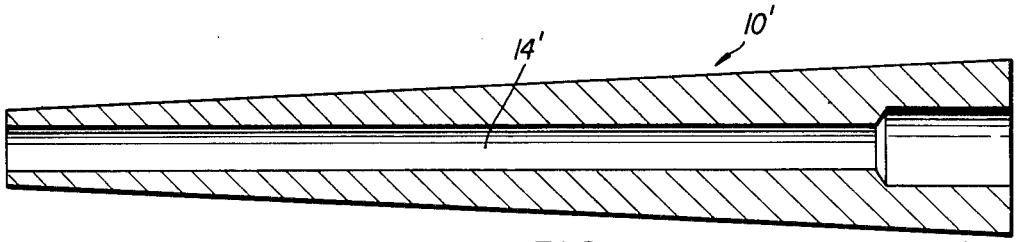
Figure 10:
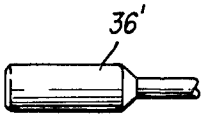
Figure 11:
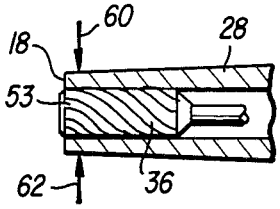
Figure 12:
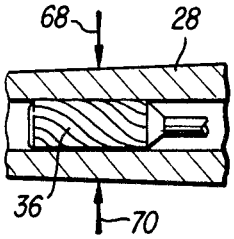
Figure 13:
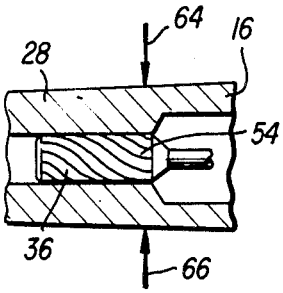
Figure 14:
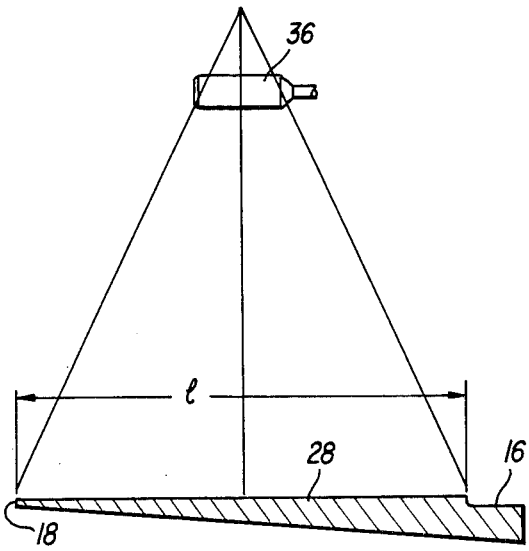
Figure 17:
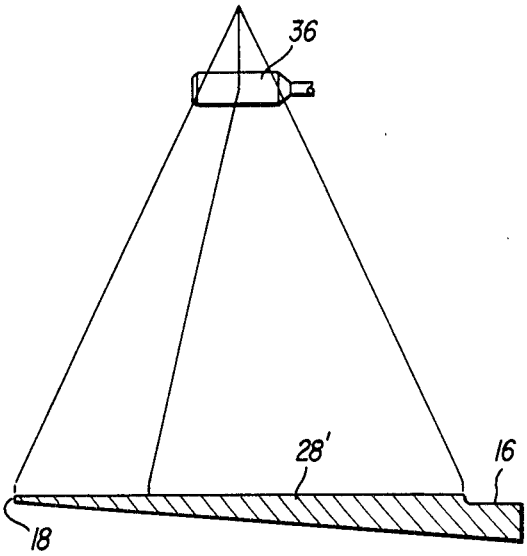
Figure 15:
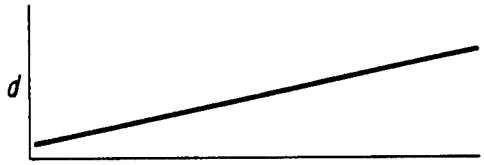
Figure 18:
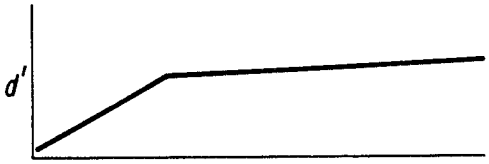
Figure 16:
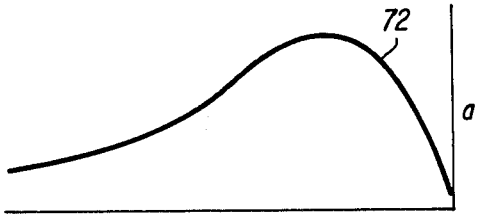
Figure 19:
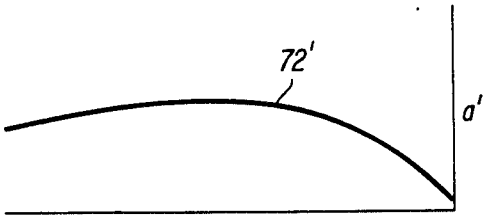

FIG. 2 is a sectional view on the same scale as FIG. 1 showing a tube and mandrel useful for producing the rifled barrel of the present invention; and FIG. 3 is a view of the mandrel of FIG. 2 on a greatly enlarged scale; and FIG. 4 is a sectional view on an enlarged scale taken along line 4—4 of FIG. 3; and FIG. 5 is a sectional view on an enlarged scale taken along line 5—5 of FIG. 3; and FIG. 6 is a partial sectional view of an enlarged scale taken along line 6—6 of FIG. 1; and FIG. 7 is a sectional view on an enlarged scale taken along line 7—7 of FIG. 1; and FIG. 8 is a view of projectile on an enlarged scale; and FIG. 9 is a sectional view of a gun barrel of the present invention having a smooth bore; and FIG. 10 is a view of a smooth mandrel useful to produce the gun barrel of FIG. 9; and FIG. 11 is a partial sectional view showing the point of hammering with the mandrel near the muzzle; and FIG. 12 is a partial sectional view showing the point of hammering when the mandrel is at an intermediate position; and FIG. 13 is a partial sectional view showing the point of hammering when the mandrel is near the breech; and FIG. 14 is a schematic representation showing the relationship between the point of hammering on the mandrel and the gun barrel; and FIG. 15 is a graph showing the relationship between the depth of the groove and the length of the gun barrel; and FIG. 16 is a graph showing the relationship of the acceleration of a projectile as it passes down the gun barrel; and FIG. 17 is a schematic representation showing the relationship between the point of hammering on the mandrel and the gun barrel; and FIG. 18 is a graph showing the relationship between the depth of the groove and the length of the gun barrel; and FIG. 19 is a graph showing the relationship of the acceleration of a projectile as it passes down the gun barrel; and FIG. 20 is a sectional view taken along line 20—20 of FIG. 2; and FIG. 21 is a sectional view taken along line 21—21 of FIG. 1.

According to one aspect of the present invention, there is provided a process for producing a gun barrel. This process comprises the steps of:

I. inserting a mandrel into a metal tube wherein the inside diameter of the tube is greater than the outside diameter of the mandrel; and then II. collapsing the tube radially inwardly to mechanically deform the tube until the inside of the tube takes the form of the outside of the mandrel; and then III. removing the mandrel from the tube; and then IV. heating the tube to a temperature above the recrystallization temperature of the metal but below the melting point of the metal; and then V. quenching the tube; and then VI. tempering the tube to produce a gun barrel.

According to the present invention, there is provided a gun barrel having a cartridge chamber and a bore in communication therewith. The bore is provided with a plurality of lands and grooves. The grooves are both wider and deeper adjacent to the chamber than they are adjacent to the muzzle.

The gun barrel of the present invention is produced employing a mandrel. The mandrel comprises a shaft and a cylindrical portion. The shaft is employed for moving the mandrel with respect to the inside of the tube. The cylindrical portion is attached to the shaft and has mandrel lands and mandrel grooves. The mandrel lands produce grooves in the tube whereas the mandrel grooves produce lands in the tube. One end of the mandrel has mandrel lands which are both wider and deeper than the same mandrel lands at the other end of the mandrel.

According to the broadest aspects of the process of the present invention any smooth or rifled mandrel can be employed. However, as described more completely below special advantages are gained when a rifled mandrel of the present invention is employed in the process of the present invention.

Collapsing of the tube radially inwardly can be performed by any convenient process which smoothly and evenly collapses the tube. Processes such as forging, rolling, or hammering can be employed. These processes are described in Dicke U.S. Pat. No. 2,104,319 and in the publication entitled "Barrel Forging Machines for Processing Gun Barrels" published by Gesellschaft fuer Fertigungstechnik and Maschinenbau Aktiengesellschaft A4407 Steyr, ennser Strasse 14, Austria, copyright 1976 hereinafter referred to as "GFM". The step of collapsing the tube is preferably conducted at ambient temperature and pressure, namely, 20° C. and 760 mmHg. However, elevated temperatures up to the forging temperature, usually about 900° C., are suitable.

In the process of the present invention the mandrel is caused to move relative to the tube. In order to effect this relative movement, the tube can be held stationary and the mandrel moved, or the mandrel can be held stationary and the tube moved.

The step of heating the tube to a temperature above the recrystallization temperature can be accomplished by any convenient meabs such as burning gases, hot gases, electrical heating or electrical induction. The tube is heated to a temperature above the recrystallization temperature. As used herein the term "recrystallization temperature" means $AC_3$ and is the third plateau exhibited on a time-temperature graph when the metal of the tube is heated. Recrystallization temperature is a well known characteristic which varies with the chemical composition of the metal selected. Heating to just barely above the recrystallization temperature is adequate for the purposes of the present invention but takes a relatively long time. It is, therefore, preferred in accordance with the present invention to heat the metal of the tube to a temperature generally from 5° to 200° and preferable from 10° to 100° C. above the recrystallization temperature. When heated to a temperature within this range, it is generally sufficient if the metal is permitted to remain at this temperature for a period of two minutes to two hours. Ten minutes to one hour is preferred. Longer times are possible but yield no benefit.

The quenching can be accomplished by any process which rapidly reduces the temperature of the tube from the temperature attained in the heating step to a low temperature and generally less than 120° C. The preferred method of quenching is by immersing the hot tube in a heat conducting liquid such as oil or water. It is not possible to quench too rapidly. However, quenching too slowly will result in undesirable characteristics in the metal. It is generally perferred to reduce the temperature of the tube to below 120° C. in less than 15 minutes and preferably in less than one minute.

The step of tempering can be conducted in accordance with conventional tempering techniques. Generally, tempering comprises heating the metal to a given elevated temperature followed by cooling it to ambient temperature. The steps of heating and subsequent cooling can be conducted once or more than once. The step of tempering is conducted until the material exhibits a tensile strength of at least 80 kg/mm$^2$ and preferably at least 100 kg/mm$^2$. The tube is then permitted to cool to room temperature.

The nature of the tempering will vary with the alloy selected but generally heating to 500° to 900° C. for periods of two to 120 minutes is sufficient.

According to a special embodiment of the present invention, the inside of the tube is provided with a layer of metallic chromium. A wide variety of metallic diffusion coating processes can be employed in order to provide this chromium layer. However, the preferred process is that known as chromizing. Chromizing is described, for example, in the following publications:

Kremer, G., u. K. K. Volk: Die Herstellung und Verwendung von hitzebestaendigen Aluminiumueberzuegen. Stahl u. Eisen 66/67 (1947) S. 250/57. (Werkstoffaussch. 653); and Becker, G., K. Daeves u. F. Steinberg: Oberflaechenbehandlung von Stahl durch Chromdiffusion. Stahl u. Eisen 61 (1941) S. 289/94; and Becker, G., u. K. Bungardt: Verbesserung der Zunderbestaendigkeit bei hochwarmfesten Staehlen und Legierungen durch Eindiffusion von Metallen. DEW-Techn. Ber. 1 (1961) Heft 4, S. 150/55.

The chromizing can occur at either of two critical places in the process. The chromizing can occur after the removing of the mandrel from the tube and together with the heating, but is preferably conducted just prior to inserting the mandrel into the tube. When the chromizing is conducted just prior to inserting the mandrel into the tube, the inside of the tube acquires an even covering of chromium. If chromizing is not employed in the present invention then the heating step must be conducted in the absence of oxygen.

The chromizing temperature is 1000° C. When the chromizing process is finished then the barrel is ready for quenching.

According to another aspect of the present invention, when no chromium layer is provided, the absence of oxygen is achieved by either (a) the use of a vacuum or (b) the presence of a noble gas.

When employing a vacuum any subatmospheric pressure which removes substantially all the oxygen is sufficient. However, subatmospheric pressures of less than 1 mm Hg are generally sufficient. Any noble gas can be employed such as neon, xenon, or argon. Argon is preferred because of cost and availability.

After evacuating or after filling the tube with inert gas, the ends of the tube are sealed by plugs, by welding or by any convenient means. These seals are not removed until after the tube is tempered.

The gun barrel of the present invention can be subjected to conventional subsequent steps such as machining, and nitriding. The chamber in the gun barrel of the present invention can be produced according to conventional techniques such as boring or such as providing the mandrel of the present invention with an extension whose outside diameter conforms to the inside diameter of the mandrel as shown, for example, in the FIGURE of page 5 of the GFM publication previously referred to.

The process of the present invention and the mandrel of the present invention can be employed to produce gun barrels of almost any caliber greater that 20 mm. The present invention is especially applicable to calibers within the range of 20 to 155 mm. Never before has it been possible to produce a reliable gun barrel greater than 20 mm by externally collapsing a tube about a mandrel.

Especially advantageous results are achieved in the present invention when the percentage of reduction in cross sectional area of the tube is maintained within certain various critical limits. The initial cross sectional area is given by Equation No. 1:

$$A_i = \frac{(D_1^2 - D_2^2)\pi}{4} \quad \text{(Eq 1)}$$

wherein:

$A_i$ is the initial area; and $D_1$ is the inside diameter; and $D_2$ is the outside diameter; as shown in FIG. 20.

The final cross sectional area after collapsing is given by Equation No. 2:

$$A_f = \frac{(D_3^2 - D_4^2)\pi}{4} \quad \text{(Eq 2)}$$

wherein:

$A_f$ is the final area $D_3$ is the inside diameter after collapsing; and $D_4$ is the outside diameter after collapsing; as shown is FIG. 21.

The percentage reduction R is given by Equation No. 3:

$$R = \frac{A_i - A_f}{A_i} \Big| 100 \quad \text{(Eq 3)}$$

In accordance with a preferred embodiment the percentage reduction is generally between 20 and 50 and is preferably between 30 and 40. When much less the resultant barrel does not have sufficient strength. When much greater, the process yields too much strength and the structure of the barrel material will be damaged.

It is a special advantage of the present invention that a wide variety of previous known low-carbon, low-alloy steels can be employed as the metal in the present invention. The metal must be ductile, cold-formable and heat-treatable. A preferred metal is that containing the following elements which are present in the indicated range of weight percent as shown in Table 1 below.

TABLE 1

| Element | Range of Weight Percent |
|---|---|
| C | 0.10 to 1.00 |
| Si | 0.10 to 1.00 |
| Mn | 0.30 to 2.00 |
| Cr | 0.10 to 5.00 |
| Fe | Balance essentially |

Another preferred class of metals having no relationship to the class in Table 1 are those containing the following elements which are present in the indicated range of weight percent as shown in Table 2 below.

TABLE 2

| Element | Range of Weight Percent |
|---|---|
| C | 0.25 to 0.80 |
| Si | 0.20 to 0.80 |
| Mn | 0.50 to 1.00 |
| Cr | 0.50 to 4.00 |
| Mo | 0 to 2.00 |
| Ni | 0 to 0.50 |
| V | 0 to 0.50 |
| Cu | 0 to 0.20 |
| P | 0 to 0.07 |
| S | 0 to 0.07 |
| Fe | Balance essentially |

Specific metals include those with the following DIN designations. "DIN" is an abbreviation for the German language word "Deutsche Industrie Normalen" which translates into english as "German Industrial Standard."

The DIN numbers are 1.6513, 1.6582, 1.7220, 1.7225, 1.7361, and 1.7561. Other suitable metals bear AISI designators 4320 and 4340.

Referring now to the drawings in general and in particular to FIG. 1, there is shown a rifled barrel 10 of the present invention. The barrel 10 has a chamber 12 and a bore 14 in communication with the chamber 12. The chamber 12 is in the breech 16 of the barrel 10. The opposite end of the barrel 10 is the muzzle 18. The barrel 10 is provided with a plurality of lands such as the lands 20, 22 and is provided with a plurality of grooves such as the grooves 24, 26. As can be seen by reference to FIGS. 6 and 7, the groove 26 adjacent to the chamber 12 is both wider and deeper than is the groove 24 adjacent to the muzzle 18.

Referring now to FIGS. 2 and 3, there is shown in FIG. 2 a tube 28 having a breech end 30 and a muzzle end 32 and a bore 34. Within the bore 34 is a mandrel 36. The inside diameter "A" of the tube 28 is slightly greater than the outside diameter "B" of the mandrel 36 (FIG. 3). As shown in FIG. 2, hammers 38, 40 are positioned outside the tube 28 adjacent to the muzzle 32 in position for collapsing the tube 28 about the mandrel 36.

As shown in FIG. 3, the mandrel 36 comprises a shaft 42 and a cylindrical portion 44 attached to the shaft 42. The shaft 42 is employed to move the mandrel 36 longitudinally with respect to the inside of the tube 28. The mandrel 36 is provided with a plurality of lands such as the lands 46, 48 and with a plurality of grooves such as the grooves 50, 52. The mandrel 36 has a muzzle end 53 and a breech end 54. The shaft 42 could alternatively be attached to the muzzle end 53.

As can be seen more clearly by reference to FIGS. 4 and 5, the mandrel land 46 is not as high and is not as wide as is the mandrel land 48 shown in FIG. 5. In FIGS. 4 and 5 the differences in height and width between the land 46 and the land 48 are greatly exaggerated for illustrative purposes. The exact amount of the difference is critical to the present invention and is explained elsewhere herein. When the tube 28 is collapsed about the mandrel 36, the mandrel land 46 produces the barrel groove 24 shown in FIG. 6 whereas the mandrel land 48 produces the barrel groove 26 shown in FIG. 7. After the tube 28 is collapsed about the mandrel 36, the width "C" of the mandrel land 46 corresponds to the width "D" of the barrel groove 24. Similarly, the depth "E" of the land 46 of the mandrel 36 corresponds to the depth "F" of the barrel groove 24. Similarly, the width "G" of the land 48 corresponds to the width "H" of the groove 26 whereas the depth "J" of the land 28 corresponds to the depth "K" of the groove 26.

Referring now to FIG. 8, when a projectile 55 equipped with a rotating band 56 together with its cartridge case (not shown) is inserted in the chamber 12 of the rifled barrel 10 and is fired, the rotating band 56 first encounters the groove 26 adjacent the chamber 12. The metal of the rotating band 56 is deformed and generally takes the shape of the groove 26. However, as the projectile 55 travels down the bore 14 toward the muzzle 18, the rotating band 56 begins to wear. However, in accordance with the present invention, the rotating band 56 encounters an ever decreasing cross sectional area of the groove. By the time the rotating band 56 leaves the muzzle 18, the rotating band 56 is in contact with a groove 24 of reduced height and width. By virtue of the structural relationships herein described, the rotating band 56 maintains a substantially gas tight contact with the bore 14 from the breech 16 to the muzzle 18, contacting over the entire length of the bore 14 the grooves 24, 26. This greatly inhibits the undesirable leakage of gas past the rotating band 56, ensures that the designed effect of the explosive charge is realized and ensures that the projectile 55 will rotate about its axis 58 during flight. These advantages have not been heretofore realized.

A 20 mm barrel will generally have from 12 to 18 and preferably 15 lands and an equal number of grooves. A 40 mm barrel will generally have from 23 to 32 and preferably 27 lands and an equal number of grooves. Each groove in the barrel 10 generally and uniformly decreases its dimensions such that each groove has, when at the chamber 12, the profile shown in FIG. 6 and when at the muzzle 18 has the profile shown in FIG. 7.

The difference in the depth of the grooves in the rifled barrel is generally from 0.05 mm to 1.0 mm and preferably from 0.1 mm to 0.6 mm from the muzzle to the breech. The grooves exhibit a similar width difference.

Referring now to FIGS. 9 and 10, there is shown in FIG. 9 a gun barrel 10' of the present invention having a smooth bore. The smooth bore 14' is devoid of lands and grooves. The smooth bore 14' is produced by collapsing the tube (not shown) around a mandrel 36' whose outer surface is smooth and is free of lands and grooves.

Referring now to FIGS. 11, 12 and 13, there is illustrated one preferred method of collapsing the tube 28 around the mandrel 36. In the embodiment shown in FIG. 11 the muzzle end 53 of the mandrel 36 is positioned evenly within the muzzle 18 of the tube 28. Hammering takes place directly opposite the muzzle end 53 at the locations and in the direction indicated by the arrows 60,62. However, when the breech end 54 of the mandrel 36 is adjacent the breech 16 of the tube 28 as shown in FIG. 13, hammering takes place directly opposite the breech end 54 of the mandrel 36, as shown by the arrows 64,66. At intermediate positions on the tube 28 hammering takes place at intermediate positions as shown by the arrows 68, 70 in FIG. 12.

Referring now to FIGS. 14, 15 and 16, there is grraphically illustrated that embodiment of the present invention wherein the tube 28 is collapsed about the mandrel 36 when the arrows 6, 70 in FIG. 12 are exactly at the midpoint of the tube 28. If hammering progresses evenly along the tube 28, then as shown in FIG. 15 the depth "d" of a single groove will increase with respect to the length "l" along the length of the tube from the muzzle 18 to the breech 16. Such a tube 28 will exhibit a curve 72 when acceleration "a" is plotted against length "l" as shown in FIG. 16.

However, according to another preferred embodiment of the present invention illustrated by FIGS. 17, 18 and 19, intermediate collapsing of the tube 28 as shown in FIG. 12 can occur at a position other than the midpoint of the tube. The tube 28' will then exhibit a graph of depth "d'" versus length "l" as shown in FIG. 18 giving an acceleration curve 72' as shown in FIG. 19. The acceleration curve 72' is superior to the acceleration curve 72 since the curve 72' provides for more even acceleration over the length "l" of the tube 28' formed into a resultant gun barrel 10.

Tubes useful in the present invention can be manufactured according to well-known prior art techniques. Among these techniques are spin casting and the so called "Mannesmann Processs".

The invention may be better understood by reference to the following examples. These examples are designed to represent the best mode contemplated for practicing the present invention.

EXAMPLE 1

A metal tube 18 in the form of a truncated cone having a diameter at the breech of 15.2 cm and a diameter at the muzzle of 9.3 cm and having a central bore having a diameter of 2.65 cm is selected. The metal of the tube 28 has the following composition in weight percent:

| | |
|---|---|
| C | 0.3 to 0.35; |
| Si | 0.35; |
| Mn | 0.6; |
| P | 0.15; |
| Cr | 2.8; |
| Ni | 0.25; |
| Mo | 0.8 to 1.0; |
| V | 0.25 to 0.35; |
| Cu | 0.10. |
| Fe | balance |

A mandrel 36 is selected having a total of 18 lands and an equal number of grooves. The lands adjacent to the mandrel shaft have a width of 3.242 mm and a depth of 0.50 mm. Each land farthest from the mandrel shaft 42 has a width of 2.934 mm and a depth of 0.375 mm. The tube 28 is inserted into a GFM machine and the hammers 38, 40 caused to operate while the mandrel 36 is slowly pulled down the tube while keeping the hammers 38, 40 directly over the mandrel such that the hammers 38, 40 are directly over the end of the mandrel adjacent to the shaft when the end of the mandrel corresponds with the breech 30 of the tube 28. This radial hammering of the tube 28 collapses the tube 28 until the inside wall of the tube 28 contacts the mandrel 36 and fills the mandrel grooves forming barrel lands and grooves.

The mandrel 36 is then removed from the tube 28, whereupon the tube 28 is filled with argon at 20° C. and 760 mmHg. The muzzle 18 and the breech 16 of the tube 28 are then sealed.

The tube 28 is heated to a temperature of 930° C. for fifteen minutes and then is immediately immersed in ice water. The temperature drops from the temperature in the heating step to less than 100° C. in about 45 seconds.

Then, in order to temper the tube 28, it is heated to 800° C. and maintained at that temperature for 90 minutes. The tube 28 is then removed from the heat and immersed in ice water. The muzzle 18 and the breech 16 of the tube are opened, whereupon the resultant tube 28 is termed a rifled barrel 10 of the present invention.

EXAMPLE 2

The procedure of Example 1 is repeated employing the same times, temperatures and conditions with the exceptions that the tube 28 is subjected to an initial chromizing process and the argon filling and muzzle and breech sealing steps are omitted.

EXAMPLE 3

The procedure of Example 2 is repeated employing the same times, temperatures and conditions with the single exception that the tube 28 is provided with a layer of chromium by the chromizing process after collapsing around the mandrel and together with heating of the tube.

EXAMPLE 4

The procedure of Example 1 is repeated employing the same times and conditions with the single exception that the step of filling the tube 28 with argon is omitted, and in its place the bore 34 is connected to a vacuum pump which reduces the pressure in the bore 34 to 0.5 mmHg.

EXAMPLE 5

The procedure of Example 1 is repeated employing the same times and conditions with the single exception that (a) the tube has an internal diameter of 145 mm and (b) the mandrel 36 is replaced with the mandrel 36' having a smooth outer surface. A gun barrel 10' having a smooth bore 14', having an inside diameter of 120 mm results. The resultant gun barrel is useful on a battle tank.

EXAMPLE 6

The procedure of Example 1 is repeated employing the same times and conditions except that hammering of the mandrel 36 is accomplished as described herein with respect to FIG. 17. The grooves in the barrel exhibit a profile as shown in FIG. 18. A projectile exhibits acceleration, "a'", as shown in the graph of FIG. 19.

What is claimed is:

1. A process for producing a gun barrel comprising the steps of:

I. inserting a mandrel into a tube having an inside diameter greater than the outside diameter of the mandrel; and then II. collapsing the tube radially inwardly to mechanically deform the tube until the inside of the tube takes the form of the outside of mandrel; and then III. removing the mandrel from the tube; and then IV. heating the tube to a temperature above the recrystallization temperature to the metal but below the melting point of the metal; and then V. quenching the tube; and then VI. tempering the tube to produce a gun barrel having an inside diameter of greater than 20 mm.

2. The process of claim 1 wherein the collapsing of the tube is conducted to an extent such that the cross sectional area of the tube is reduced from 20 to 50 percent.

3. The process of claim 1 wherein the collapsing is conducted at ambient temperature and pressure.

4. The process of claim 1 wherein the collapsing is conducted at a temperature between 20° C. and 900° C.

5. The process of claim 1 wherein the recrystallization temperature is that temperature known as $AC_3$.

6. The process of claim 1 wherein the heating in Step IV is conducted for a time until the entire tube is heated to a temperature which is 5° to 200° C. above the recrystallization temperature.

7. The process of claim 1 wherein the heating in Step IV is conducted in the absence of oxygen.

8. The process of claim 1 wherein the heating of Step IV is conducted in a vacuum.

9. The process of claim 1 wherein the heating of Step IV is conducted in the presence of a noble gas.

10. The process of claim 1 wherein the quenching of Step V lowers the temperature of the metal to a temperature less than 120° C. in a time less than 15 minutes.

11. The process of claim 1 wherein the tempering of Step VI is conducted until the metal exhibits a tensile strength of at least 80 kg/mm$^2$.

12. The process of claim 1 wherein the tempering of Step VI is conducted by heating the metal to a temperature of 500° to 900° C. and by holding the metal at that temperature for a period from two to one hundred twenty minutes.

13. The process of claim 1 wherein the inner surface of the tube is chromized prior to inserting the mandrel in Step I.

14. The process of claim 1 wherein the inside diameter of the gun barrel is chromized after removing the mandrel in Step III together with heating in Step IV.

15. The process of claim 1 wherein the inside of the gun barrel is subjected to a nitriding step after the tempering of Step VI.

16. The process of claim 1 wherein the mandrel is rifled and wherein a rifled gun barrel is produced.

17. The process of claim 1 wherein the mandrel is smooth and wherein the resultant gun barrel has a smooth bore.

18. The process of claim 1 wherein the metal contains the following elements which are present in the indicated range of weight percent:

| Element | Range of Weight Percent |
|---|---|
| C | 0.10 to 1.00 |
| Si | 0.10 to 1.00 |
| Mn | 0.30 to 2.00 |
| Cr | 0.10 to 5.00 |
| Fe | balance essentially |

19. The process of claim 1 wherein the metal contains the following elements which are present in the indicated range of weight percent:

| Element | Range of Weight Percent |
|---|---|
| C | 0.25 to 0.80 |
| Si | 0.20 to 0.80 |
| Mn | 0.50 to 1.00 |
| Cr | 0.50 to 4.00 |
| Mo | 0 to 2.00 |
| Ni | 0 to 0.50 |
| V | 0 to 0.50 |
| Cu | 0 to 0.20 |
| P | 0 to 0.07 |
| S | 0 to 0.07 |
| Fe | balance essentially |

20. The process of claim 1 wherein the recrystallization temperature is that temperature known as $AC_3$ and wherein the heating in Step IV is conducted for from two to sixty minutes to raise the tube temperature from 5° to 200° C. above $AC_3$; and the quenching of Step V lowers the temperature of the metal to 120° C. in a time less than five minutes; and the tempering of Step VI is conducted by heating the tube to 500° to 900° C. for one to two hours to temper the metal of the tube.

21. A process for producing a rifled barrel having an inside diameter of at least 20 mm comprising the steps:

I. inserting a mandrel into a metal tube, wherein the mandrel comprises:

A. a shaft for moving the mandrel longitudinally with respect to the inside of the tube; and B. a cylindrical portion attached to the shaft having mandrel lands which produce grooves in the tube and have mandrel grooves which produce lands in the tube;

wherein that portion of the mandrel adjacent to the shaft has mandrel lands which are 0.1 to 0.6 mm wider than the same mandrel land remotest from the shaft;

wherein that portion of the mandrel adjacent to the shaft has mandrel lands which are 0.1 to 0.6 mm deeper than the same mandrel land remotest from the shaft;

wherein the mandrel has an outside diameter less than the inside diameter of the tube;

wherein the mandel has a length less than one-half that of the tube;

wherein that portion of the mandrel remotest from the shaft is aligned with the muzzle of the tube;

wherein the metal is ductile, cold-formable and heat-treatable; and wherein the metal contains the following elements which are present in the indicated range of weight percent:

| Element | Range of Weight Percent |
|---|---|
| C | 0.25 to 0.80 |
| Si | 0.20 to 0.80 |
| Mn | 0.50 to 1.00 |
| Cr | 0.50 to 4.00 |
| Mo | 0 to 2.00 |
| Ni | 0 to 0.50 |
| V | 0 to 0.50 |
| Cu | 0 to 0.20 |
| P | 0 to 0.07 |
| S | 0 to 0.07 |
| Fe | balance essentially; |

and then

II. collapsing the tube radially inwardly by radially hammering the metal to the tube at the muzzle of the tube until the transverse area of the tube has been reduced by 30 to 40 percent and until the inside wall of the tube contacts the mandrel and fills the mandrel grooves forming barrel lands; and III. moving the mandrel slowly toward the breech of the tube while moving the point of hammering to keep it always over the mandrel but at the muzzle end of the mandrel when the mandrel is near the muzzle and at the breech end of the mandrel when the mandrel is near the breech; and then IV. removing the mandrel from the tube; and then V. filling the tube with argon at a temperature of 20° C. and at a pressure of 760 mmHg; and then VI. sealing the muzzle and the breech of the tube; and then VII. heating the tube to a temperature 10° to 100° C. above $AC_3$ for two to sixty minutes; and then VIII. quenching the tube by reducing its temperature from that of the proceding step to a temperature less than 120° C. in an elapsed time of less than one minute by immersing the tube in cold water; and then IX. heating the tube to 500° to 900° C. for one to two hours in order to temper the metal of the tube; and then X. lowering the temperature of the tube to room temperature; and then XI. opening the muzzle and the breech of the tube whereupon the resultant tube is termed a rifled barrel.

22. A process of producing a gun barrel comprising the steps of:

I. inserting a mandrel into a tube, said mandrel comprising:

A. a shaft for causing relative movement between the mandrel and the inside of the tube, and B. a cylindrical portion attached to the shaft having mandrel lands which produce grooves in the tube and having mandrel grooves which produce lands in the tube, wherein that portion of the mandrel adjacent to the shaft has mandrel lands which are both wider and deeper than the same mandrel lands remotest from the shaft, and wherein the mandrel has an outside diameter less than the inside diameter of the tube; and then II. collapsing the tube radially inwardly to mechanically deform the tube until the inside of the tube takes the form of the outside of the mandrel; and then III. removing the mandrel from the tube; and then IV. heating the tube to a temperature above the recrystallization temperature of the metal but below the melting point of the metal; and then V. quenching the tube; and then VI. tempering the tube to produce a gun barrel.

23. The process of claim 22 wherein the resultant gun barrel has an inside diameter of greater than 20 mm.

24. The process of claim 22 wherein that portion of the mandrel adjacent to the shaft has mandrel lands which are 0.1 to 0.6 mm wider than the same mandrel land remotest from the shaft, and wherein that portion of the mandrel adjacent to the shaft has mandrel lands which are 0.1 to 0.6 mm deeper than the same mandrel land remotest from the shaft.

* * * * *

UNITED STATES PATENT OFFICE

CERTIFICATE OF CORRECTION

Patent No. 4,622,080 Dated November 11, 1986

Inventor(s) WOLFGANG WEGWERTH

It is certified that error appears in the above-identified patent and that said Letters Patent are hereby corrected as shown below:

Column 10, in Claim 1, line 6 of Column 10, for "greater than" read --at least--.

Signed and Sealed this

Twenty-seventh Day of January, 1987

*Attest:*

DONALD J. QUIGG

*Attesting Officer* *Commissioner of Patents and Trademarks*